US005322168A

United States Patent [19]

Kataoka

[11] Patent Number: 5,322,168

[45] Date of Patent: Jun. 21, 1994

[54] SHEET OF CORRUGATED PAPER FOR PRODUCING A PACKING

[75] Inventor: Hachiro Kataoka, Nagoya, Japan

[73] Assignee: Chuoh Pack Industry Co. Ltd., Aichi, Japan

[21] Appl. No.: 957,766

[22] Filed: Oct. 15, 1992

[30] Foreign Application Priority Data

Dec. 19, 1991 [JP] Japan ..... 3-355255

[51] Int. Cl.[5] ..... B65D 81/02; B31B 1/26

[52] U.S. Cl. ..... 206/588; 206/583; 493/162; 493/405; 493/967; 493/968

[58] Field of Search ..... 229/120.15, 120.16, 229/164; 206/521, 583, 588, 591, 592, 453, 45.14; 493/162, 405, 967, 968

[56] References Cited

U.S. PATENT DOCUMENTS 2,527,701 10/1950 Buttery ..... 229/164 X
2,723,796 11/1955 Malmgren ..... 229/120.16 X
2,946,498 7/1960 Williamson ..... 206/45.14 X
2,946,500 7/1960 Hooper et al. ..... 229/120.16 X

FOREIGN PATENT DOCUMENTS 0799310 11/1968 Canada ..... 229/120.24
0615490 1/1949 United Kingdom ..... 229/164

*Primary Examiner*—Bryon P. Gehman
*Attorney, Agent, or Firm*—Fred Philpitt

[57] ABSTRACT

According to a preferred embodiment of the invention a flat sheet of corrugated paper for producing a packing has a symmetrical shape and includes (i) two parallel central creases (A) extending from one edge (30) of the sheet to an opposed edge (31) thereof, (ii) five wall members (10) to (14), (iii) two first end sections (1), (iv) two outer side sections (2) located outside the wall members and the respective central creases (A), (v) two top sections (3) located outside the respective outer side sections (2), (vi) two inner side sections (5) partly surrounded by the respective top sections (3), (vii) two bottom sections (6) located outside the respective inner side sections (5), and (viii) two pairs of second end sections (20) located outside the respective inner side sections (5). Each wall member is partly defined by an inclined crease (25) making an angle of 45 degrees with the central crease (A), the sections located outside of the wall members and of the central creases (A) being divided from each other by creases parallel to the central creases (A).

2 Claims, 5 Drawing Sheets

SHEET OF CORRUGATED PAPER FOR PRODUCING A PACKING

FIELD OF THE INVENTION

This invention relates to sheets of corrugated paper for producing packings.

BACKGROUND OF THE INVENTION

Packings of Styrofoam are widely used to support the ends of sides of an electronic product, such as a home video unit, a car radio, or a cartridge for a copy machine, in a cardboard box. The packings act as a cushion to protect the product against damage if it is shocked during transportation or handling. Styrofoam, however, is derived from petroleum resources, which are limited. In addition, Styrofoam is awkward when it is disposed as rubbish. So it is preferable to avoid using Styrofoam if possible. Another material used for the same purpose is pieces of corrugated paper stuck together. Corrugated paper is reclaimable, and in this respect it is preferable to Styrofoam. Pieces of corrugated paper stuck together, however, take a relatively long time to prepare. Also it is costly to prepare them. In addition, they do not provide sufficient cushioning effect.

SUMMARY OF THE INVENTION

The object of the invention is to provide sheets of corrugate paper for producing packings which are free from the foregoing drawbacks of pieces of corrugated paper stuck together.

BRIEF DESCRIPTION OF THE DRAWING

FIG. 6 shows a flat sheet of corrugated paper which embodies the invention in another preferred from;

DETAILED DESCRIPTION OF PREFERRED EMBODIMENTS

First embodiment

A packing which embodies the invention in one preferred form will now be described with reference to FIGS. 1 to 5.

Figure 1:
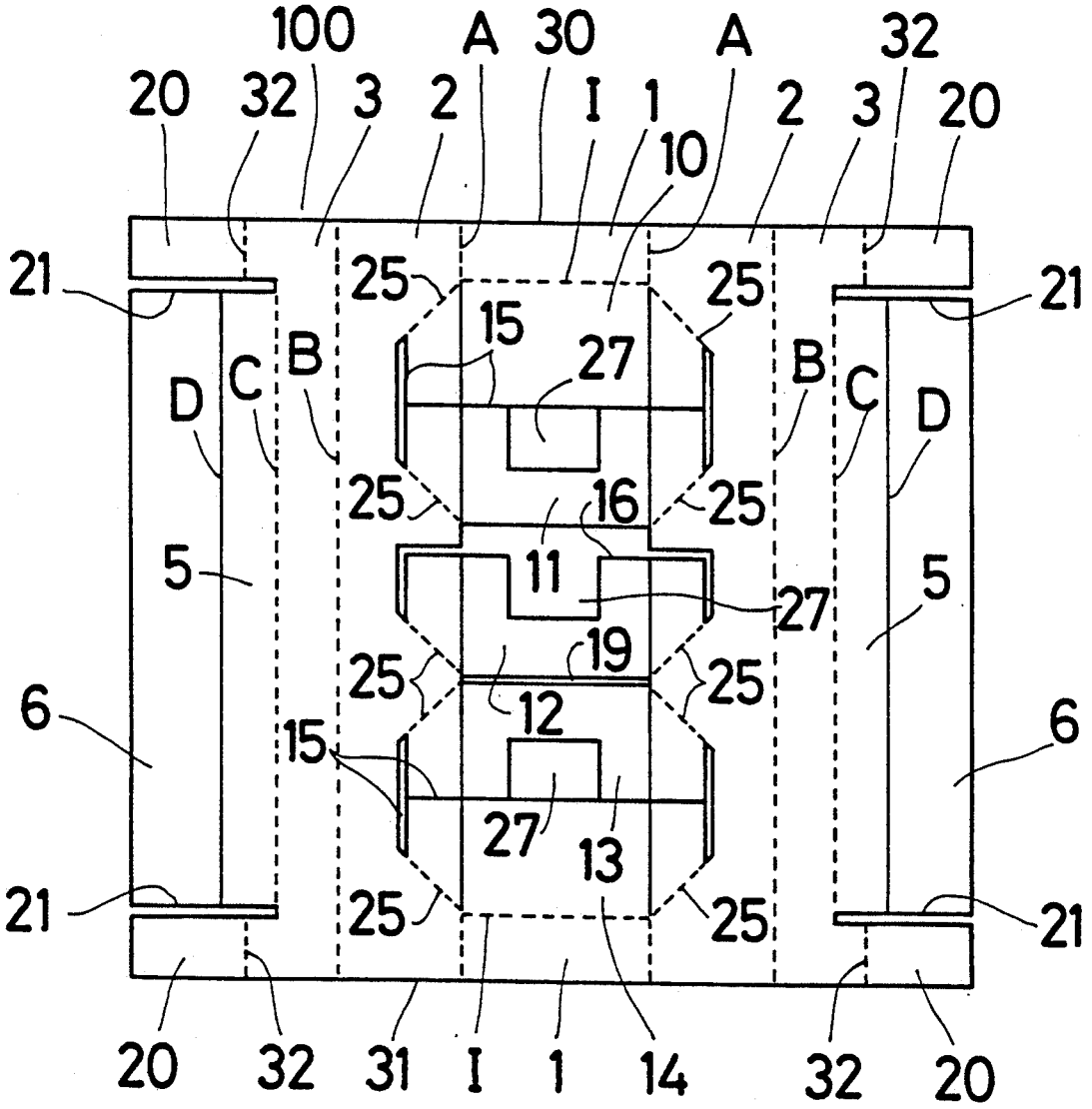
FIG. 1 shows a flat sheet of corrugated paper which embodies the invention in one preferred form.

FIG. 1 depicts a flat sheet 100 of corrugated paper. At its center the sheet 100 includes wall members 10, 11, 12, 13, and 14. First wall member 10 is defined by a transverse crease I, two inclined creases 25, and a first cut 15. Second wall member 11 is defined by the first cut 15, two inclined creases 25, and an opening 16, and has a recess 27. Third wall member 12 is defined by the opening 16, a recess 27, two inclined creases 25, and a slit 19. Fourth wall member 13 is defined by the slit 19, two inclined creases 25, a second cut 15, and a recess 27. Fifth wall member 14 is defined by the second cut 15, two inclined creases 25, and a transverse crease I. Two parallel central creases A extend from one side 30 of the sheet 100 to the opposed side 31 thereof. The greater parts of the central creases A pass through the wall members 10 to 14. Each inclined crease 25 makes an angle of 45 degrees with the central crease A. Reference numeral 1 designates first end sections. As illustrated, each of the first and second cuts 15 generally has the shape of the letter "I."

As clearly shown, the sheet 100 has a symmetrical shape and, hence, only one side thereof will now be described. Outside the central crease A is located an outer side section 2. The inner side of the outer side section 2 is defined by the wall members 10 to 14 and the crease A. The outer side of the outer side section 2 is defined by a crease B. Outside the outer side section 2 is located a top section 3. The outer side of the top section 3 is defined by a crease C, short creases 32, and slits 21. Outside the crease C is located an inner side section 5. The outer side of the inner side section 5 is defined by a crease D. Outside the crease D is located a bottom section 6. Outside the short creases 32 are located second end sections 20.

Figure 2:
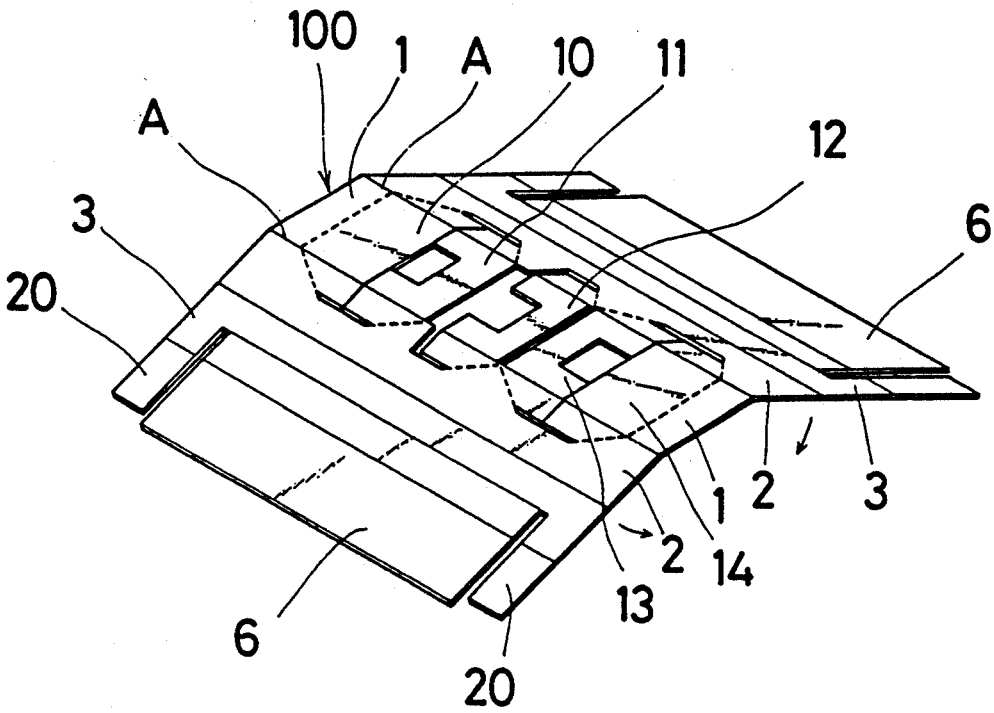
FIGS. 2, 3, and 4 show how to fold the flat sheet of FIG. 1.
Figure 3:
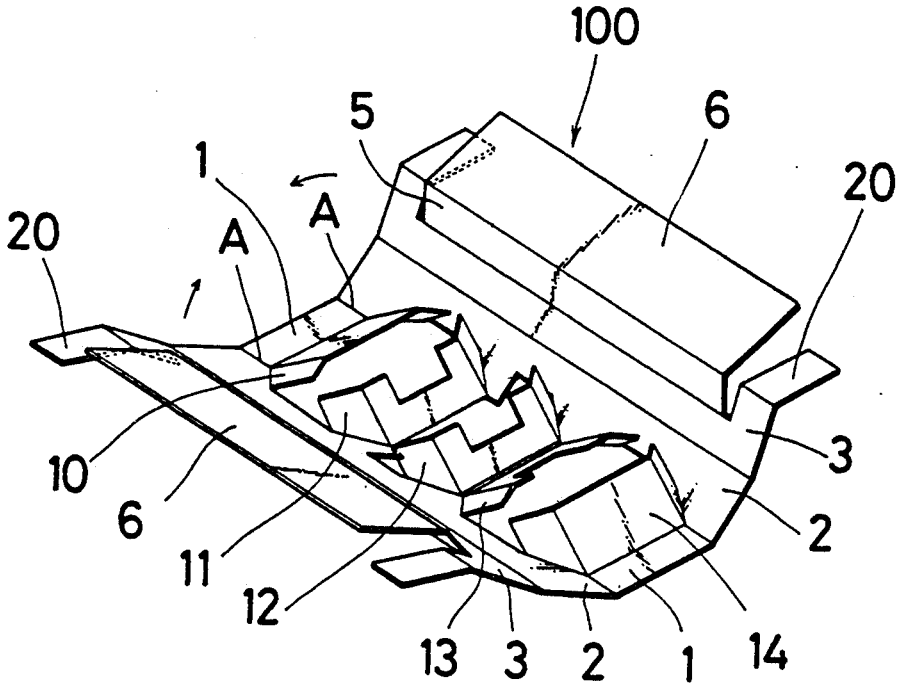
Figure 4:
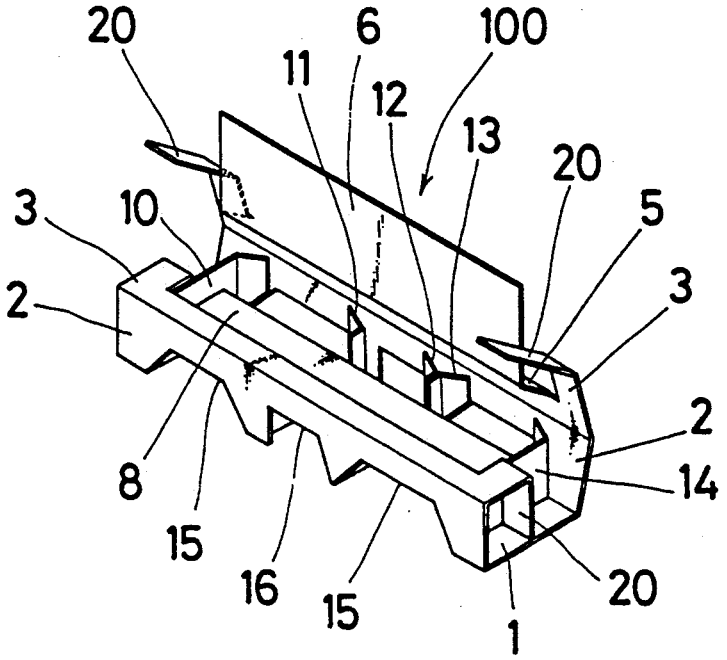
Figure 5:
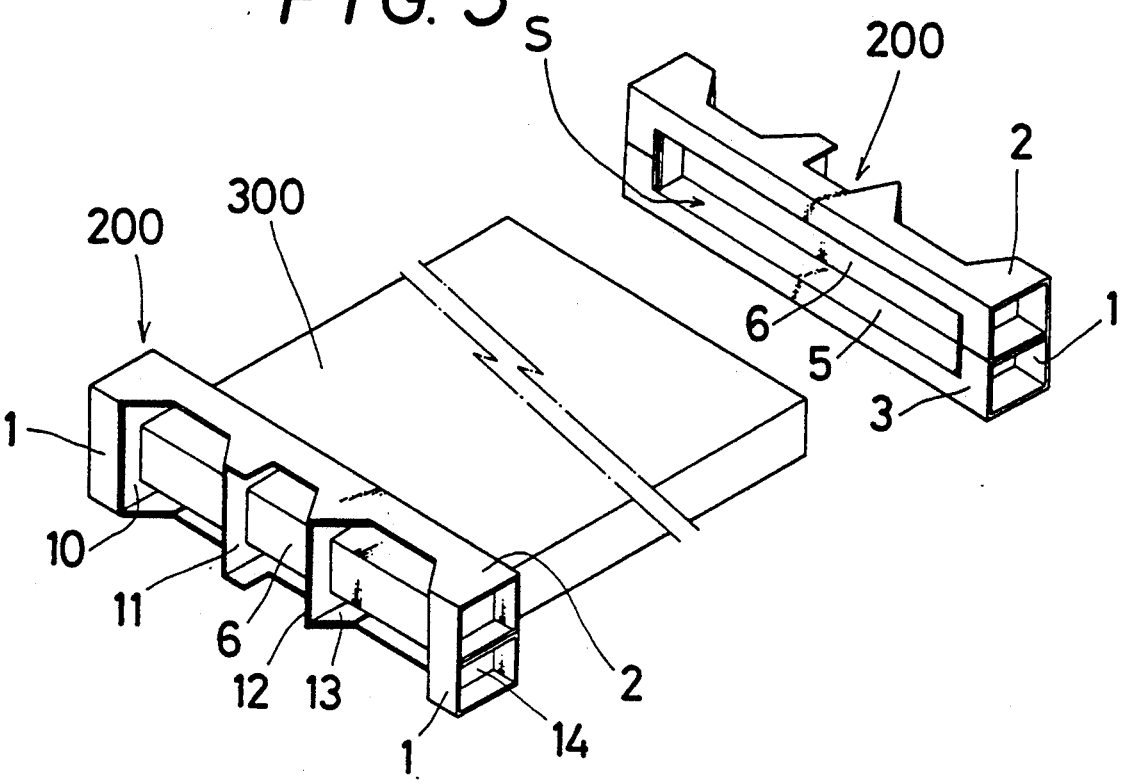
FIG. 5 shows a packing produced by folding the sheet of FIG. 1.

FIG. 5 shows a packing 200 produced by folding the sheet 100. The first step required to produce the packing 200 is to turn down the sheet 100 for a certain angle from the central creases A, as shown in FIG. 2. It facilitates the standing of the wall members 10 to 14. Then, as shown in FIG. 3, the outer side sections 2 are folded upward from the central creases A until the outer side sections 2 come to upright positions. It causes the wall members 10 to 14 to stand simultaneously with the outer side sections 2. That is, the wall members 10 to 14 stand from the transverse creases I and the inclined creases 25. As a result, the portions of the wall members 10 to 14 located outside the creases A come into contact with the outer side sections 2. Then, the bottom sections 6 are folded outward from the creases D in advance (FIG. 3). Also in advance the inner side sections 5 and the second end sections 20 are folded inward from the creases C and 32, respectively (FIG. 4). Then, the top sections 3 are folded inward from the creases B. It results in the following:

(a) The central parts of the top sections 7 get supported on the nonrecessed portions of the second, third and fourth wall members 11, 12 and 13.

(b) The inner side sections 5 come into contact with the vertical walls of the recesses 27 of the wall members, and get opposed to the outer side sections 2.

(c) The bottom sections 6 get snugly fitted on the bottoms of the recesses 27. To be more exact, one bottom section 6 rests directly on the bottoms of the recesses 27, and the other bottom section 6 rests on the first bottom section 6.

(d) The second end sections 20 rest on the first end sections 1, making right angles with the latter.

A packing 200 of FIG. 5 with an inner space S is thus produced. The inner space S is a space on the bottom sections 6. Typically, as shown in FIG. 5, two packings 200 are used to support opposed ends of a product 300. That is, the opposed ends of the product are received in the inner spaces S. Then, the whole is put in a package (not shown) such as a cardboard box. Thus the packings 200 protect the content 300 against damage if it is shocked during transportation. The packings 200 have the same degree of effect of cushioning the content as conventional packings of Styrofoam.

Second embodiment

Figure 6:
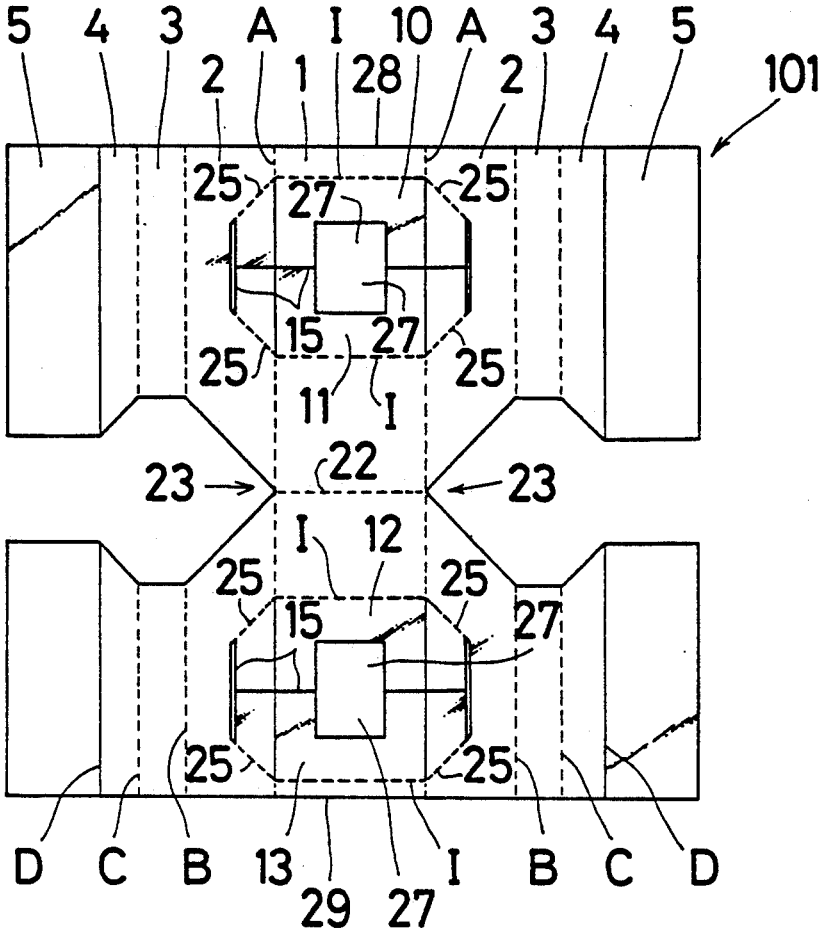
Figure 7:
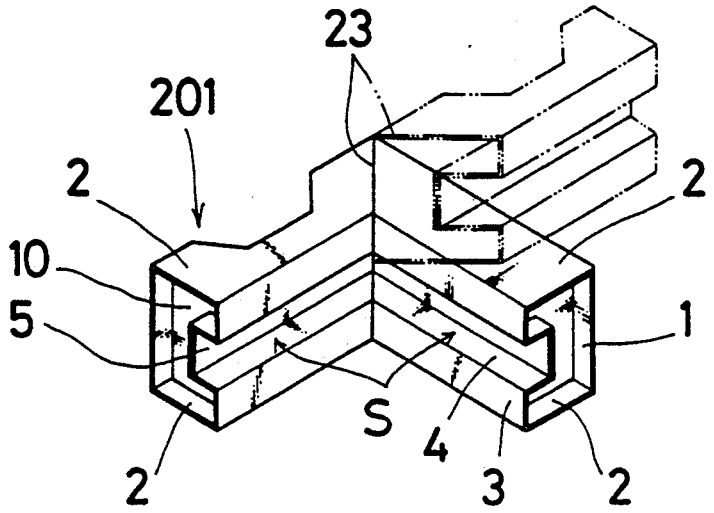
FIG. 7 shows a packing produced by folding the sheet of FIG. 6.

In addition, a flat sheet 101 of corrugated paper of FIG. 6 can be folded into a packing 201 of FIG. 7. The packing 201 is used to support a corner of a product.

The flat sheet 101 of FIG. 6 has two parallel central creases A extending between one edge 28 of the sheet 101 to the opposed edge 29 thereof. The creases A define a base 1. The continuity of the base 1, however, is broken by four wall members 10, 11, 12, and 13. Also, the base 1 is divided into two halves by a central transverse crease 22. Each wall member is defined by a transverse crease I, by two inclined creases 27 extending outward from the respective creases A in symmetrical directions, and by a cut 15 generally having the shape of the letter "I." Also each wall member has a central recess 27. The recesses 27 of first and second wall members 10 and 11 communicate with each other. Also the recesses 27 of third and fourth wall members 12 and 13 communicate with each other. The first and second wall members 10 and 11, as a whole, form an octagonal shape. Also the third and fourth wall members 12 and 13, as a whole, form an octagonal shape. Each inclined crease 25 makes an angle of 45 degrees with the central crease A.

As clearly shown, the flat sheet 101 has a symmetrical shape with respect to both a first centerline (not shown) running between and along the central creases A and a second centerline (not shown) passing through the transverse crease 22. Thus it may be said that the sheet 101 has four symmetrical elements. Outside the two adjacent wall members (10 and 11 or 12 and 13) and the central crease A is located an outer side section 2. The outer side section 2 has a crease D as an outer side. Outside the crease D is located a top section 3. The top section 3 has a crease C as an outer side. Outside the crease C is located an inner side section 4. The inner side section 4 has a crease D as an outer side. Outside the crease D is located a bottom section 5.

The symmetrical elements which are symmetrical with respect to the second centerline are separated from each other by a V-shaped space 23.

The sheet 101 is first folded into two halves of a packing 201. Procedure for doing so is similar to that for folding the sheet 100 into the packing 200. The V-shaped spaces 23 are present between the two halves. Then, the two halves are folded from the transverse crease 22 so as to eliminate the spaces 23. As a result, a packing 201 to receive a corner of a product is obtained.

Third embodiment

Figure 8:
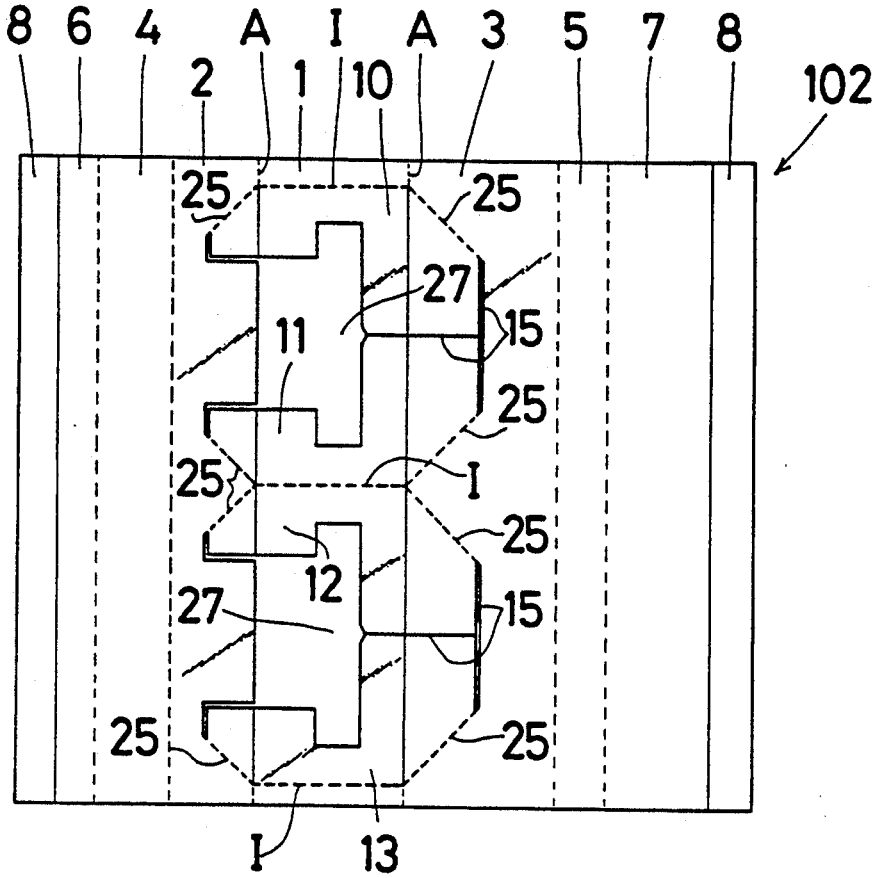
FIG. 8 shows a flat sheet of corrugated paper which embodies the invention in still another preferred form.
Figure 9:
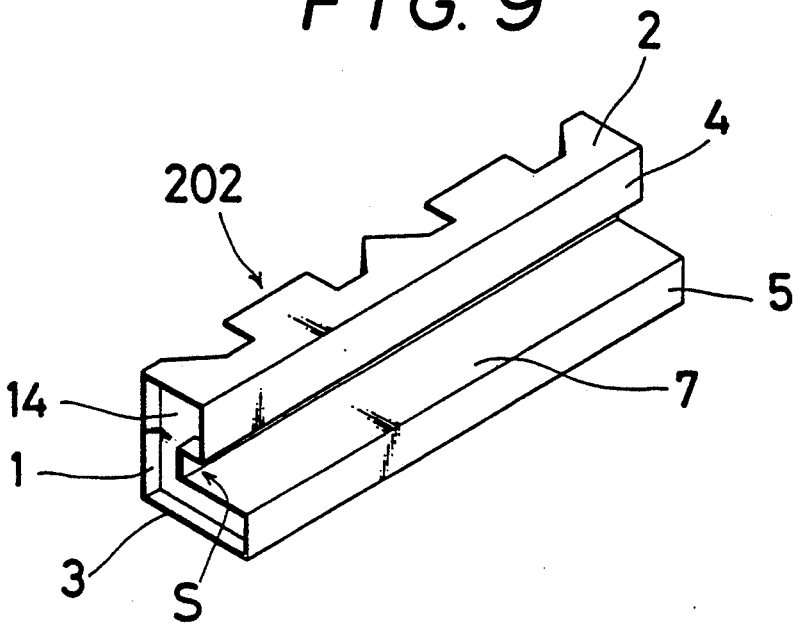
FIG. 9 shows a packing produced by folding the sheet of FIG. 8.

In addition, a flat sheet 102 of corrugated paper of FIG. 8 can be folded into a packing 202 of FIG. 9.

The sheet 102 includes wall members 10, 11, 12, and 13. Each wall member is defined by a transverse crease I, by two inclined creases 25, and by a T-shaped cut 15. First and second wall members 10 and 11 have a common opening 27. Also third and fourth wall members 12 and 13 have a common opening 27. Two parallel creases A extend from one edge of the sheet 102 to the opposed edge thereof, and pass through the wall members. Each inclined crease 25 makes an angle of 45 degrees with the crease A. Reference numeral 1 designate opposed end sections. The other reference numerals designate the following:

1: opposed end sections
3: higher outer side section
5: higher top section
7: higher inner side section
8: opposed bottom sections
2: lower outer side section
4: lower top section
6: lower inner side section Higher outer section 3, higher top section 5, higher inner side section 7, and right bottom section 8 are divided from each other by straight creases. Similarly, lower outer side section 2, lower top section 4, lower inner side section 6, and left bottom section 8 are divided from each other by straight creases. The sheet 102 with such a construction can be folded into a packing 202 of FIG. 9. Procedure for doing so is similar to that for folding the sheet 100 into the packing 200.

In use, as illustrated in FIG. 9, the packing 200 is placed with the higher outer section 3 lowermost. One end or one side of a product can be received in a space S. The higher inner side section 7 provides a relatively large surface to support one end or one side of a product from below.

Any one of the sheets of the invention can be prepared only by cutting corrugated paper into the illustrated size, forming the creases, and making the openings illustrated.

What is claimed is:

1. A flat sheet (100) of corrugated paper for producing a packing, which has a symmetrical shape and comprises (a) two parallel spaced apart central creases (A) extending longitudinally from one edge (30) of said sheet to an opposed edge (31) thereof, (b) a central, first wall member (10) defined by a first transverse crease (I) extending from one to the other of said spaced apart central creases (A), by two angled creases (25) extending outwardly from said central creases (A) in symmetrical inclined directions, and by a first cut (15) generally having the shape of the letter I, (c) a central, second wall member (11) defined by said first cut (15), by two angled creases (25) extending outwardly from said central creases (A) in symmetrical inclined directions, and by an opening (16), said second wall member (11) having a central recess (27), and said first and second wall members (10 and 11) forming together an octagonal shape, (d) a central, third wall member (12) defined by said opening (16), by two angled creases (25) extending outwardly from said central creases (A) in symmetrical inclined directions, and by a slit (19) extending from one to the other of said spaced apart central creases (A), said third wall member (12) having a central recess (27), (e) a central, fourth wall member (13) defined by said slit (19), by two angled creases (25) extending outwardly from said central creases (A) in symmetrical inclined directions, and by a second cut (15) generally having the shape of the letter I, said fourth wall member (13) having a central recess (27), (f) a central, fifth wall member (14) defined by said second cut (15), by two angled creases (25) extending outwardly from said central creases (A) in symmetrical inclined directions and by a second transverse crease (I) extending from one to the other of said two central creases (A), said fourth and fifth wall members and (13 and 14) forming together an octagonal shape, (g) each of said angled creases (25) making an angle of 45 degrees with respect to said central creases (A), (h) two first end sections (1), one of which is defined by an upper edge (30), by portions of the two spaced apart central creases (A), and by said first transverse crease (I), and the other end section (1) being defined by said second transverse crease (I), by portions of said central creases (A) and by a lower edge (31), (i) two outer side sections (2) each located adjacent and laterally outwardly from a longitudinal center line of the flat sheet with respect to one of said two spaced apart central creases (A), (j) two top sections (3), each located adjacent and laterally outwardly with respect to one of said outer side sections (2), (k) two inner side sections (5), each being partly surrounded by portions of one of said top sections (3), (l) two bottom sections (6), each located laterally outwardly with respect to one of said inner side sections (5) and separated therefrom by a third crease (D), (m) two pairs of second end sections (20) each pair being attached to longitudinal ends of one of said top sections, (n) a first crease (B) extending between said upper and lower edges (30 and 31) to divide each said outer side section (2) from its adjacent top section (3), (o) two second creases (C) extending between two points spaced inwardly a short distance from said upper and lower edges (30 and 31), each second crease (C) separating one of said top sections (3) from one of said inner side sections (5), (p) two pairs of opposed short creases (32), each short crease extending inwardly from one of said upper and lower edges (30 and 31) respectively for short distances to thereby divide each of the top sections (3) from its adjacent second end section (20), and (q) two pairs of opposed transverse slits (21) spaced inwardly short distances from said upper and lower edges (30 and 31) and each pair connecting with the respective opposed ends of each second crease (C), separating said opposed short creases (32) from the adjacent third crease (D), and also separating each pair of second end sections (20) from the adjacent bottom section (6).

2. A method for producing a packing from the flat sheet set forth in claim 1 comprising the steps of (a) folding the sheet (100) relative to the central creases (A) to facilitate the subsequent movement of all the wall members (10 to 14), (b) folding said outer side sections (2) toward each other about said central creases (A) until they are both in upright positions, with the result that all the wall members (10 to 14) stand readily from the transverse creases (I) and said angled creases (25) simultaneously with said outer side sections (2), and portions of the wall members (10 to 14) located outside the central creases (A) come into contact with said outer side sections (2), (c) folding said bottom sections (6) outward from said third creases (D) in advance, and also in advance folding said inner side sections (5) and said second end sections (20) inward with respect to said second creases (C) and said short creases (32), and (d) folding said top sections (3) inward with respect to said first creases (B) with the result that (i) said top sections (3) get supported on nonrecessed portions of said second, third and fourth wall members (11, 12 and 13), (ii) said inner side sections (5) come into contact with vertical walls defining said central recesses (27) of these wall members, and are opposed to said outer side sections (2), (iii) said bottom sections (6), overlapping one another are snugly fitted on bottoms of said central recesses (27), and (iv) said second end sections (20) rest on said first end sections (1) and at right angles to said end sections (1), thereby resulting in a packing (200) having an inner space(S) for receiving one end of a product.

* * * * *